US005503336A

United States Patent [19]

Wichmann

[11] Patent Number: 5,503,336

[45] Date of Patent: Apr. 2, 1996

[54] HIGH VOLUME - LOW VOLUME ELECTROSTATIC DISPENSING NOZZLE ASSEMBLY

[75] Inventor: Frederick R. Wichmann, Cincinnati, Ohio

[73] Assignee: United Air Specialists, Cincinnati, Ohio

[21] Appl. No.: 275,037

[22] Filed: Jul. 14, 1994

[51] Int. Cl.[6] ..... B05B 5/02

[52] U.S. Cl. ..... 239/708; 239/590.5; 239/597

[58] Field of Search ..... 239/690, 690.1, 239/708, 555, 565, 566, 568, 597, 590.5, 590

[56] References Cited

U.S. PATENT DOCUMENTS

| | | |
|---|---|---|
| 2,685,536 | 8/1954 | Starkey et al. . |
| 2,706,964 | 4/1955 | Ransburg et al. . |
| 3,508,711 | 4/1970 | Switall . |
| 4,749,125 | 6/1988 | Escallon et al. . |
| 4,788,016 | 11/1988 | Colclough et al. . |
| 4,814,788 | 3/1989 | Davies . |
| 4,830,872 | 5/1989 | Grenfell . |
| 5,209,410 | 5/1993 | Wichmann et al. . |

*Primary Examiner*—Kevin P. Weldon
*Attorney, Agent, or Firm*—Frost & Jacobs

[57] ABSTRACT

An electrostatic nozzle assembly for dispensing flowable material to a predetermined target. The nozzle assembly comprises an insulative cap, an insulative base and an electrically chargeable metallic, plate-like shim therebetween. The cap and base of the nozzle assembly have sharp continuous unbroken forward edges, the cap forward edge and the adjacent portion of the base defining a continuous dispensing slot. The nozzle assembly has at least one inlet for flowable material leading to at least one distribution chamber formed in the shim. The at least one distribution chamber comprises a plurality of distribution channels defining discrete pathways having a depth of about one half the thickness of the shim and configured to distribute the flowable material from the inlet to predetermined points along the dispensing nozzle assembly. The spacing between the forward edges of the base and cap and the spacing of the cap forward edge and the forward edge of the shim are critical. The nozzle assembly may be provided with a plurality of interchangeable shims differing in the thickness and the depth of the distribution chamber channels formed therein enabling the nozzle assembly to spray fluid material over a wide range of flow rates.

16 Claims, 3 Drawing Sheets

HIGH VOLUME - LOW VOLUME ELECTROSTATIC DISPENSING NOZZLE ASSEMBLY

TECHNICAL FIELD

The invention relates to a dispensing nozzle assembly for electrostatically depositing flowable liquids over a predetermined area of a target in a controlled manner, and more particularly to such an electrostatic dispensing nozzle assembly of greatly simplified construction and characterized by the ability to spray fluids having a wide range of viscosities at both low flow rates and high flow rates with extremely even distribution.

BACKGROUND ART

Prior art workers have devoted much time and effort to the development of electrostatic dispensing nozzle assemblies to meet the demand of ever increasing applications in which a flowable material is to be uniformly applied over a predetermined area of a surface.

In general, an electrostatic dispensing nozzle assembly is provided with an elongated slot and an adjacent elongated dispensing edge. The fluid to be dispensed is distributed along the slot and provided in constant supply during the coating operation hydraulically (i.e. by mechanical means external of the nozzle such as a metering pump or the like). Means are provided within the nozzle to assure that the fluid is evenly and uniformly provided along the slot and the adjacent dispensing edge. Means are also provided within the nozzle (usually in the form of a metallic shim assembly) to apply an electrostatic charge on the fluid to be dispensed. Dropletization takes place after the fluid is introduced to the dispensing edge. The physical propulsion of the droplets to the target is the result of the attraction between the grounded target and the electrostatically charged fluid droplets. In other words, the droplets are uniformly drawn to the target by attraction due to the voltage difference between the droplets and the target.

An exemplary electrostatic dispensing nozzle assembly of the general type to which the present invention is directed is set forth in U.S. Pat. No. 5,209,410. Since, as will be apparent hereinafter, the nozzle assembly of the present invention can be supplied with fluid to be dispensed, mounted and supported in the same way taught in this patent, the teachings of this patent are hereby incorporated by reference.

Briefly, U.S. Pat. No. 5,209,410 describes an electrostatic nozzle assembly comprising a housing having a dispensing edge of a predetermined longitudinal length. The housing is made up of a base and a cap joined together to provide a substantially continuous slot adjacent the dispensing edge. Within the housing, and formed partially within the base and partially within the cap, there is a plurality of substantially hydraulically independent distribution chambers arranged serially along the longitudinal length of the housing. Each chamber is in fluid communication with the slot.

A conductive shim is located between the base and the cap and provides an electrical charge to the flowable material within the distribution chambers and the adjacent slot. This causes the flowable material to be electrostatically deposited from the nozzle assembly.

Each of the chambers of the nozzle is independently attached by a valved conduit to a source of the flowable material. Through use of the valves, the flowable material can be selectively supplied to individual distribution chambers. As a result, the dispensing process along the longitudinal length of the nozzle slot can be controlled, as desired. The nozzle can be adjusted for various widths of application without changing the structure of the nozzle. The distribution chambers of the nozzle assembly of this patent are each of a delta shape, which expands in width toward the dispensing edge.

The nozzle is provided with appropriate support means which also accommodates the valved conduits for the flowable material as well as electrical connection means by which the shim is connected to an appropriate voltage source.

The nozzle of U.S. Pat. No. 5,209,410 performs well, electrostatically dispensing the flowable material onto a target in a controllable and uniform manner. The nozzle is capable of serving both as a "shoot-down" nozzle (i.e. a nozzle aimed at a downward angle), and as a "shoot-up" nozzle (i.e. a nozzle directed at an upward angle).

Since the use of electrostatic nozzle assemblies has become so widespread, and since the applications in which they are used are so many and varied, a problem arises when a particular application requires the ability to spray fluids at a very low flow rate or at a high flow rate. Prior art electrostatic nozzle assemblies are characterized by liquid flow rate (or application rate) limitations, which cannot be exceeded.

As a result of this, the prior art has devised a number of nozzles, each designed for a particular flow rate range. Commonly assigned co-pending application Ser. No. 08/275,652, filed Jul. 15, 1994, U.S. Pat. No. 5,441,204, in the names of Daniel R. Tappel and Frederick R. Wichmann, and entitled ELECTROSTATIC FLUID DISTRIBUTION NOZZLE, teaches a nozzle assembly capable of reliable and uniform distribution across the width of the nozzle outlet opening of the fluid being dispensed, the nozzle operating at a relatively low flow rate. The teachings of this co-pending application are incorporated herein by reference.

Briefly, the co-pending application describes a nozzle comprising a nozzle body having a base and a cap. The nozzle has an inlet for receiving fluid at a relatively low pressure, and an elongated outlet opening enabling distribution of the fluid. A conductive shim assembly, located between the base and cap, provides an electrical charge to the fluid, enabling electrostatic distribution from the nozzle. The shim assembly is made up of two or more plates which, when appropriately stacked between the base and the cap define a distribution chamber comprising a plurality of distribution channels providing discrete pathways within the nozzle for distributing and directing the fluid from the inlet to predetermined dispensing points along the outlet opening. The pathways have substantially equal flow characteristics resulting in equal spraying characteristics along the length of the outlet opening. The distribution channels are part of the overall distribution chamber provided within the nozzle for receiving conductive fluid and directing it to the outlet opening in a uniform and consistent manner.

The present invention is based upon the discovery that a single electrostatic spray nozzle can be devised which will provide a full range of flow rate characteristics from very low flow rates down to about 0.04 cc/min/6 inches of nozzle with extremely even distribution to a high flow rate in excess of about 200 cc/min/6 inches of nozzle with extremely even distribution. The nozzle is provided with a plurality of shims, the selection of which will provide the flow characteristics desired. The nozzle is also of greatly simplified construction.

DISCLOSURE OF THE INVENTION

It is an object of the invention to provide an electrostatic spray nozzle which is capable of operating with extremely even distribution over a wide range of liquid viscosities and liquid flow rates from very low flow rates to high flow rates.

It is an object of the present invention to provide an electrostatic spray nozzle of simplified construction wherein the requirement for internal resilient seals is eliminated.

It is another object of the present invention to provide an electrostatic spray nozzle with a variety of single or multiple one-piece shims, appropriate selection of which will enable proper operation of the nozzle with extremely even distribution over a wide range of fluid flow rates and fluid viscosities. The word "multiple" used above relates to instances where the length of the nozzle is such that it requires two or more shims arranged end-to-end along the nozzle.

Yet another object of the present invention is to provide an electrostatic spray nozzle having one or more inlets. Each shim of the nozzle is provided with one or more distribution chambers, equal in number to the number of nozzle inlets, each distribution chamber comprising a network of discrete distribution channels for directing fluid to be dispensed from an inlet of the nozzle to a series of adjacent points along the nozzle outlet.

It is also an object of the present invention to provide an electrostatic spray nozzle wherein the one or more distribution chambers, formed in the shim, assure balanced flow of fluid to the nozzle firing edge.

Finally, it is an object of the invention to provide an electrostatic nozzle wherein machining requirements of the cap and base are greatly simplified.

According to the invention there is provided an electrostatic nozzle assembly for dispensing flowable material onto a predetermined target over a wide range of liquid viscosities and liquid flow rates or application rates. The electrostatic dispensing nozzle of the present invention comprises a housing made up of a base and a cap formed from blocks of insulative material and having substantially planar inner and outer surfaces. The base and cap have inner and outer surfaces as well as side, forward, and rearward edge surfaces. The forward edge surfaces of the base and cap slope rearwardly and outwardly, forming with their respective inner surfaces a sharp, continuous, unbroken, forward edge on both the cap and the base.

The base and cap are fastened together with an electrically chargeable shim located between their inner surfaces. A continuous dispensing slot is formed between the base and the cap along the forward edge surface of the cap. At least one distribution chamber is formed in the shim. When two or more such distribution chambers are formed in the shim, they are identical, substantially hydraulically independent, and are arranged in side-by-side relationship along the length of the shim. The nozzle has an inlet for each distribution chamber.

Each distribution chamber for each nozzle inlet comprises a plurality of distribution channels defining discrete pathways within the nozzle for distributing and directing the fluid from its respective inlet to predetermined dispensing points along the dispensing slot of the nozzle. Each dispensing chamber comprises a first channel which divides into a first set of two channels. The first set of two channels divides into a second set of four channels, and this division into channel sets continues until a final set of channels is located in closely spaced parallel relationship perpendicular to the dispensing slot. All of the channels of the channel sets are of the same depth, comprising about ½ the thickness of the shim. All of the channels of a given set are of the same width, and this width diminshes from channel set-to-channel set, the channel set adjacent the dispensing slot being the narrowest.

The nozzle is provided with a plurality of interchangeable shims. The shims differ from each other only in the depth of the channel sets and therefore the overall thickness of the shim which is approximately twice the depth of its respective channel sets. By appropriate shim selection, the nozzle has the ability to spray fluids at a flow rate ranging from about 0.04 cc/min/6 inches of nozzle to about 200 cc/min/6 inches of nozzle with extremely even distribution.

The spacing of the forward sharp edges of the base and cap with respect to each other and the spacing of the forward sharp edge of the cap with respect to the forwardmost longitudinal edge of the shim are critical. The nozzle can be used in any orientation ranging from upwardly vertical to downwardly vertical. The nozzle cap and base are joined together by fastening means which pass through the shim and which are so arranged with respect to the one or more distribution chambers of the shim that no resilient sealing means are required with respect to either the cap or the base and the shim.

DETAILED DESCRIPTION OF THE INVENTION

Figure 1:
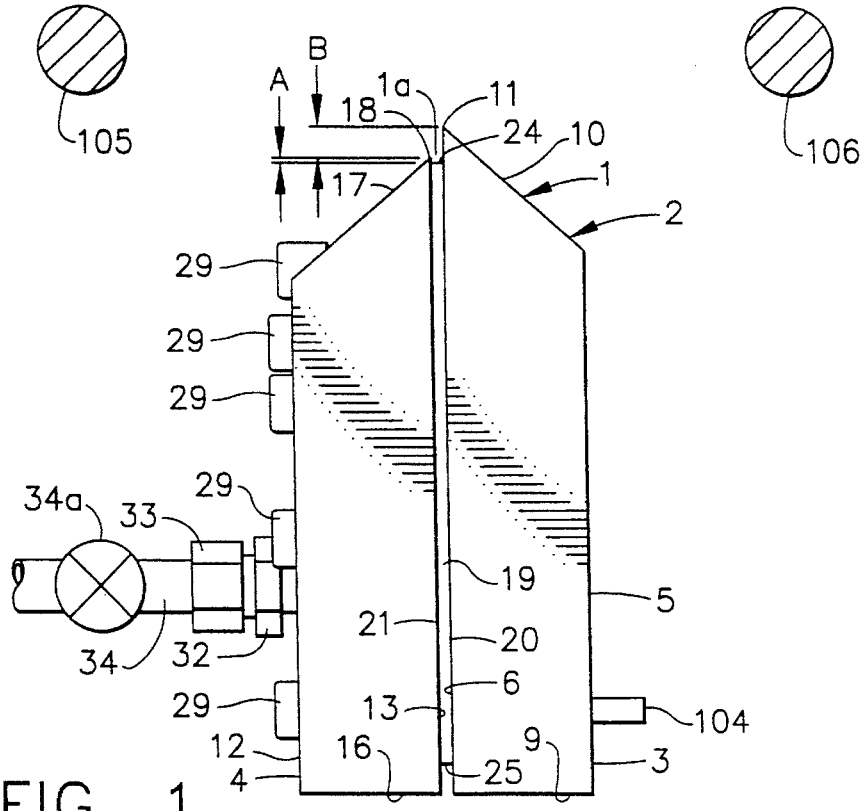
FIG. 1 is an end elevational view of the electrostatic nozzle of the present invention.
Figure 2:
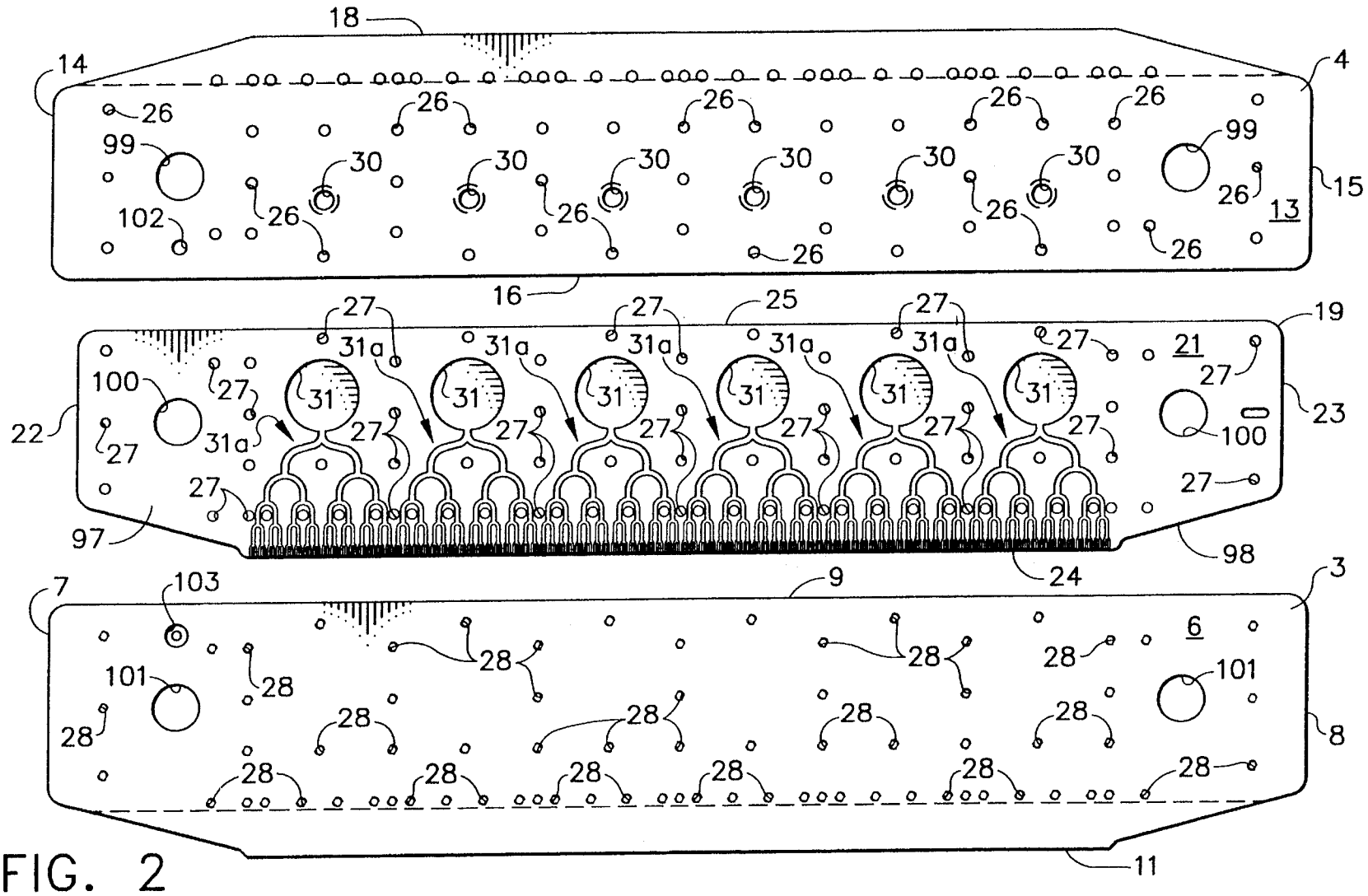
FIG. 2 is an exploded view of the nozzle of FIG. 1.

Reference is made to FIGS. 1 and 2 wherein like parts have been given like index numerals. The nozzle of the present invention is generally indicated at 1 and comprises a housing generally indicated at 2. The housing 2 is made up of two parts, a base 3 and a cap 4. The base 3 and cap 4 are made of insulative material, as is well known in the art. The base 3 and the cap 4 may have any appropriate longitudinal dimension, depending upon the size of the nozzle required.

The base 3 has substantially planar and parallel outer and inner surfaces 5 and 6. The base 3 has end edge surfaces 7 and 8 (see FIG. 2), as well as rearward and forward edge surfaces 9 and 10. The terms "rearward" and "forward" are arbitrary and are used simply for purposes of description. The edge surface 10 is characterized as the "forward" edge surface simply because it is adjacent the dispensing slot of the nozzle, as will be set forth hereinafter. While this terminology is selected for purposes of description, it will be obvious to one skilled in the art that the nozzle can have various orientations, as will further be described hereinafter.

The forward edge surface 10 of base 3 slopes outwardly and rearwardly, and forms with the planar inner surface 6 a sharp, continuous, unbroken, forward edge 11.

The cap 4 has substantially planar and parallel outer and inner surfaces 12 and 13. The cap 4 has end edge surfaces 14 and 15 (see FIG. 2), together with rearward and forward edge surfaces 16 and 17. The forward edge surface 17 of cap 4 slopes outwardly and rearwardly, forming with the inner surface 13 a sharp, continuous, unbroken, forward edge 18.

The nozzle 1 also incorporates a metallic shim indicated at 19. As shown in FIG. 1, the shim 19 is located between base 3 and cap 4. For purposes of an exemplary showing, the shim is illustrated as being of exaggerated thickness, as will be apparent hereinafter. The shim 19 has planar outer surfaces 20 and 21, end edges 22 and 23 (see FIG. 2), as well as front and rear edges 24 and 25.

The cap 4 has a plurality of holes 26. The shim 19 has a corresponding set of holes 27 and the base 3 also has a corresponding set of holes 28. The cap holes 26 and the shim holes 27 are of smooth bore, while the base holes 28 are threaded. When the cap 4, shim 19 and base 4 are assembled, as in FIG. 1, they are held together by a plurality of machine screws each passing through a hole 26 in cap 4, a corresponding hole 27 in shim 19 and threadedly engaged in a corresponding hole 28 of base 3. Five of the many such machine screws are shown at 29 in FIG. 1. The holes 26 of cap 4 may be counterbored at the outside surface of cap 4, to partially, at least, receive the heads of machine screws 29. As will discussed further hereinafter, the machine screws 29 hold the cap 4, shim 19 and base 3 together in a sufficiently tight fashion as to prevent fluid leakage between base surface 6 and shim surface 20 and between cap surface 13 and shim surface 21.

The cap 4 is shown as having six threaded bores 30. As will be clear hereinafter, the number of threaded bores 30 is not a limitation of the present invention. The shim 19 has a corresponding number of circular depressions 31 formed therein. The depressions 31 are intended to be substantially coaxial with the threaded bores 30 when the nozzle is assembled, each threaded bore 30 and its corresponding circular shim depression 31 constitute a fluid inlet for nozzle 1. While it would be within the scope of the present invention to provide a small nozzle with a single fluid inlet 30-31, usually there will be more than one fluid inlet 30-31, the number depending upon the length of the nozzle. When the number of fluid inlets 30-31 is greater than one, all of the fluid inlets will be identical. For purposes of an exemplary showing, FIG. 2 illustrates a nozzle having a 12 inch dispensing slot and a total of six fluid inlets 30-31.

As is shown in FIG. 1, each of the threaded bores 30 of the nozzle inlets 30-31 is provided with a fitting 32 threadedly engaged therein. The fitting 32 threadedly receives the connector 33 of a conduit 34. The conduit 34 contains a valve at **34*a* and is connected to a manifold (not shown) for the fluid to be dispensed. It will be understood that each of the threaded bores 30 of cap 4 will have its own fitting 32 for a valved conduit 34 leading to the manifold. By appropriate manipulation of the conduit valves, the spray along the length of the dispensing slot can be controlled, as can be the width of the spray from nozzle 1**.

As is most clearly shown in FIG. 2, each of the circular depressions 31 in shim 19 has a laterally extending distribution chamber in the form of a plurality of distribution channels providing discrete pathways within the shim for distributing and directing the fluid from the inlets 30–31 to predetermined discrete points along the nozzle dispensing slot 1 a defined as the space between the forwardmost sharp edge 18 of cap 4 and the adjacent inner surface 6 of base 3. All of the distribution chambers are identical and are indicated generally at **31*a* in FIGS. 2 and 3**.

Since the distribution chambers **31*a* are identical, a description of one of the distribution chambers 31*a*** will suffice as a description of all of the distribution chambers.

Figure 3:
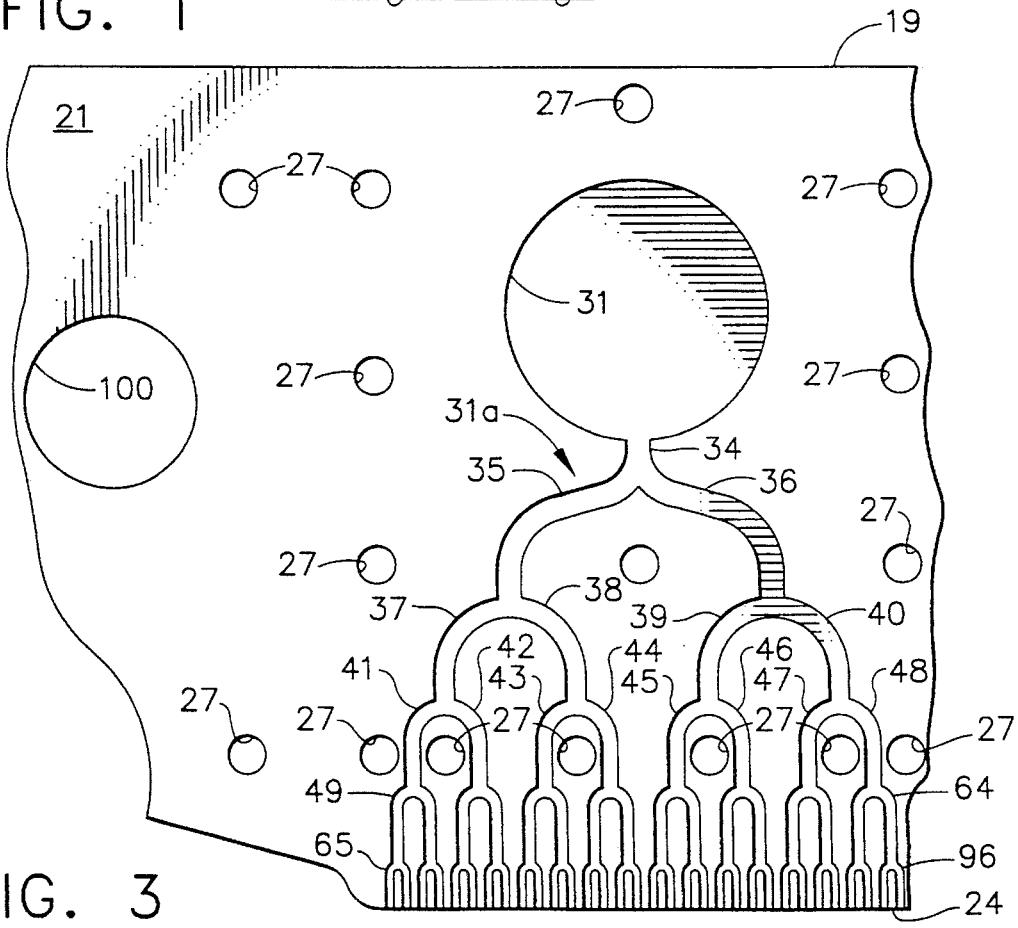
FIG. 3 is an enlarged fragmentary view of a shim, illustrating an exemplary distribution chamber formed therein.
Figure 3A:
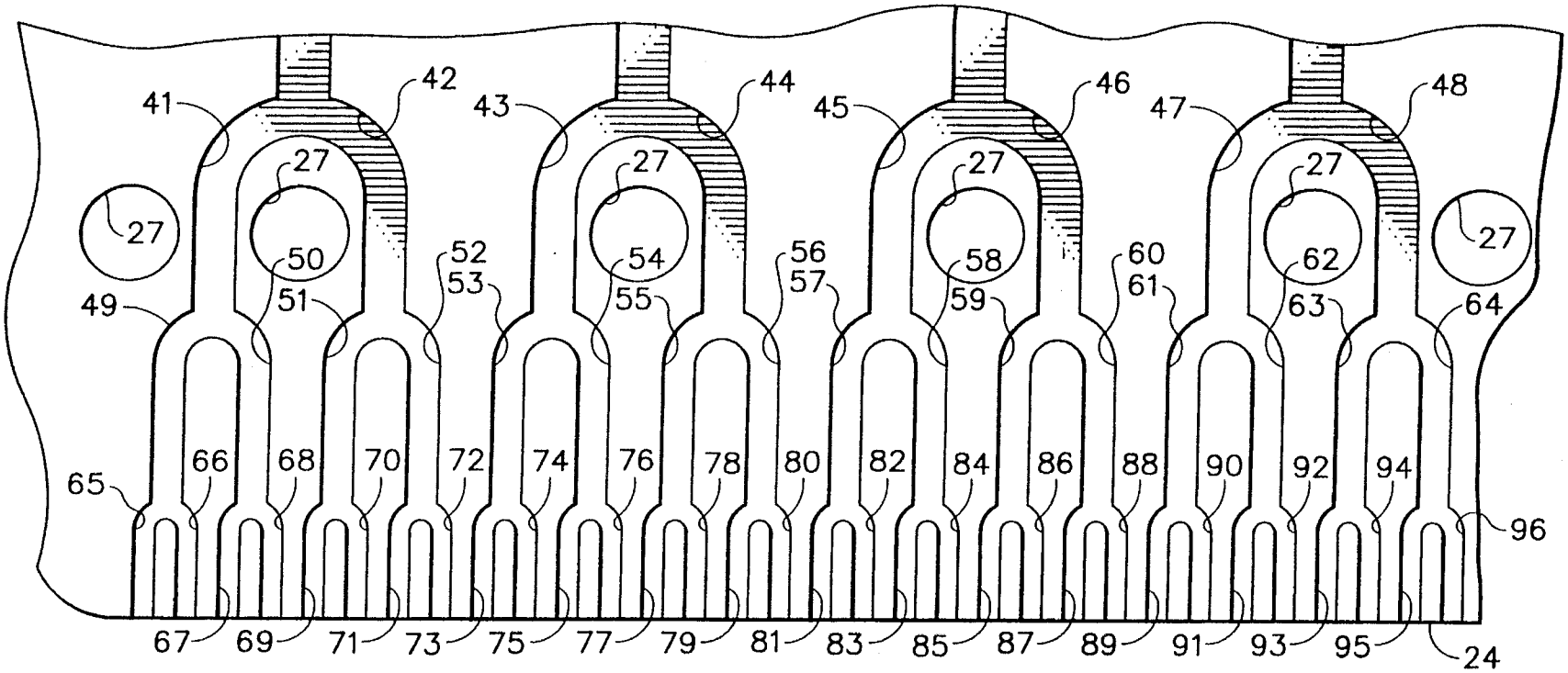
FIG. 3A is an enlarged fragmentary view of the lower portion of FIG. 3.

FIGS. 3 and 3A illustrate the left hand most distribution chamber **31*a*, as viewed in FIG. 2. The circular depression 31 and the channels of the distribution chamber 31*a* are formed in the shim 19 and extend downwardly from shim surface 21 to a depth of about ½ the shim thickness, as will be further discussed hereinafter. The distribution chamber 31*a* comprises a first channel 34 which branches into a first series of two channels 35 and 36. Channels 35 and 36, themselves, branch into a second series of four channels 37–40. In similar fashion, the four channels 37–40 branch into a third series of eight channels 41–48. Each of the channels 41–48 branch into a fourth series of 16 channels 49–64. Finally, the fourth series of channels 49–64 divide into a fifth series of 32 channels 65–96**.

As indicated above, the circular depression 31 and all of the channels 34–96 are of equal depth (i.e. about 50% of the thickness of shim 19. The channels of each series are of the same length and the same width.

It will be noted from FIGS. 2 and 3 that the cap holes 26, the shim holes 27 and the base holes 28 for receipt of the machine screws 29 which join the cap 4, shim 19 and base 3 together are carefully placed so as to be dispersed between the distribution chamber channels and to substantially surround circular depressions 31. When the base 3, shim 19 and cap 4 are assembled, the depressions 31 and the channels of distribution chambers 3 la face the inside surface 13 of cap 4. Since the surfaces 20 and 21 of shim 19 and the inside surfaces 6 of base 3 and 13 of cap 4 are planar, the placement of the machine screws 29 is such as to preclude leakage of the fluid being dispensed, and unlike most prior art nozzles, no resilient sealing devices are required between shim 19 and base 3, or between shim 19 and cap 4. In instances where the length of the nozzle is such as to require two or more shims located end-to-end along the nozzle, portions equivalent to portions 97 and 98 will be provided, one each, on the endmost shims.

It will be noted in FIG. 2 that the shim 19 is provided with end portions 97 and 98 which extend beyond the dispensing slot la. As is known in the art, in order to further control the distribution and flow of the fluid to be electrostatically dispensed from the nozzle, it is helpful to provide an electrical field slightly beyond the longitudinal ends of the dispensing slot. The ends 97 and 98 serve as field gates which ensure that the flowable material is electrostatically dispensed at the opposite longitudinal ends of the dispensing slot in a predictable and controlled manner, and minimizes the potential of charged material being deposited on objects outside of the target area.

The manner in which the nozzle 1 is mounted does not constitute a part of the present invention. As indicated above, the nozzle may be affixed to mounting blocks (not shown) in the manner described in the above-noted U.S. Pat. No. 5,209,410. To this end, the cap 4, the shim 19 and the base 3 may be provided with corresponding holes 99, 100 and 101, respectively, for receipt of mounting bolts, or other appropriate fastening means.

As is shown in FIG. 2, the cap 4 and the base 3 are provided with coaxial perforations 102 and 103, respectively, either one of which can be used to receive a connector terminal 104 (see FIG. 1), by which the shim 19 is connected to an appropriate voltage source (not shown).

The nozzle 1 of the present invention can be used in both the "shoot-up" and "shoot-down" modes. In other words, it can be used at any angularity ranging from a vertically upward direction (shown in FIG. 1), to a vertically downward direction. In both "shoot-up" and "shoot-down"

modes, the nozzle 1 may be provided with a pair of inductor bars to optimize performance, as is well known in the art. In some cases nozzle performance is contingent on the use of and the placement of the inductor bars. A pair of inductor bars is shown in FIG. 1 at 105 and 106. The use of inductor bars is well known in the art, and their proper placement with respect to the firing edge of nozzle 1 is well within the skill of the worker in the art, and is dictated by such factors as the environment, the type of fluid being dispensed, the conductivity of the fluid being dispensed, the arc gap distance, and the like.

As will be apparent hereinafter, the width of the dispensing slot 1*a* (i.e. the thickness of the conductive shim 19) will depend upon the hydrodynamics of the material to be dispensed, and the volume to be dispensed. In general, the higher the viscosity and/or the higher the flow, the greater should be the width of the slot (i.e. the thickness of shim 19).

Turning to FIG. 1, it has been found that the distance A between the forwardmost edge 20 of shim 19 and the sharp forwardmost edge 18 of cap 4 should fall within the range of from 0 inch to about 1/32 inch. If the forwardmost edge 24 of the shim is spaced from the sharp edge 18 of cap 4 by distance greater than about 1/32 inch, the dispensing nozzle assembly 1 will not perform at its best and may not work at all in a "shoot-up" mode. It has further been determined that for best performance of the dispensing nozzle assembly 1, the distance B between the sharp edge 18 of cap 4 and the sharp edge 11 of base 3 should fall within the range of from about 11/64 inch to about 3/16 inch.

An exemplary embodiment of the nozzle of FIGS. 1–3 was built and tested. The nozzle had a 12 inch dispensing slot 1*a* and had six inlets 30-31 and six distribution chambers 31*a*. Each of the circular shim depressions 31 had a diameter of one inch. Channel 34 and the first series channels 35 and 36 each had a width of 0.084 inch. Each of the second series channels 37–40 had a width of 0.078 inch. Each of the third series channels 41–48 had a width of 0.063 inch. Each of the fourth series channels 49–64 had a width of 0.047 inch. Finally, each of the fifth series channels 65–96 had a width of 0.031 inch. The distance between adjacent fifth series channels 65–96 was 0.0313 inch. The distances A and B (see FIG. 1 ) fell within the above-stated ranges. The dimensions given above may vary, but the progression from larger to smaller dimensions remains uniform.

In this particular exemplary nozzle assembly four separate shims were provided to achieve a full range of flow rates. A first shim for low viscosity and low flow rates had a thickness of 0.006 inch and the circular depression 31 and distribution chamber 31*a* had a depth of 0.003 inches. A second shim was provided, identical to the first in all respect except that it had a thickness of 0.010 inch and the circular depression 31 and distribution chamber 31*a* had a depth of 0.005 inch. The third shim was also identical to the first shim with the exception that it had a thickness of 0.020 inch and the circular depression 31 and distribution chamber 31*a* therein had a depth of 0.010 inch. Finally, the fourth shim for use with high viscosity and/or high flow, was identical to the first shim with the exception that it had a thickness of 0.030 inch and the circular depression 31 and distribution chamber 31*a* formed therein had a depth of 0.015 inch.

This exemplary embodiment was used to coat an object with modified DOS oil manufactured by Mill Chemicals and Lubricants of Birmingham, Al. under the designation Type DSNW-70. The shim used had a thickness of 0.006 inch and the depth of the depression 31 and the distribution channels 31*a* was 0.003 inch. The target area was at earth potential and the nozzle was charged to a negative potential of 100 KV. The nozzle was positioned for spraying vertically (i.e. a "shoot-up" position) and the target was located approximately 9½ inches above the nozzle. The oil was pumped to the nozzle at a rate of 0.006 cc/min/1 inch of nozzle. Oil sensitive paper was passed in front of the target for the purpose of determining droplet size and distribution. Since the spray droplets were nearly too small to be seen without magnification, a microscope was used to determine overall spray quality. The results demonstrated an average droplet size of between 15 and 20 microns. Distribution of these droplets, although random in appearance, was uniform. The flow rate was increased to 30 cc/min/1 inch of nozzle. The droplet size and distribution remained very uniform.

The same exemplary nozzle embodiment was used to coat an object with a die lubricant manufactured by Quaker Chemical Corporation of Conshohocken, Pa. under the designation Ferrocote®/draw 61-MAL-HCL-1. The shim used had a thickness of 0.030 inch and the depth of the distribution channels was 0.015 inch. The target area was at earth potential and the nozzle was charged to a negative potential of 90 KV. The nozzle was positioned for spraying vertically down and the target was located approximately 12 inches below the nozzle. The die lubricating oil was heated to 110° F. and pumped to the nozzle at a rate of 1 cc/min./1 inch of nozzle. Oil sensitive paper was used to determine droplet size and distribution. The results demonstrated extremely small droplets visible on the paper. Excellent distribution and uniformity of spray was displayed. The flow rate was then increased to 37 cc/min./1 inch of nozzle. Droplet size and distribution remained very uniform.

From the above, it will be understood that the nozzle is capable of excellent operation over a wide range of flow rates and viscosities, while at the same time being of markedly simplified construction.

Modifications may be made in the invention without departing from the spirit of it.

What is claimed is:

1. An electrostatic nozzle for dispensing flowable material onto a predetermined target, said electrostatic nozzle having a housing comprising a base and a cap formed of insulative material, said base and cap having planar inner surfaces, outer surfaces, side surfaces and forward and rearward surfaces, said forward surfaces of said cap and base each sloping rearwardly and outwardly forming with its respective inner surface a sharp, unbroken, forward edge on both said cap and said base, said inner surfaces of said cap and base facing each other, an electrically chargeable plate-like metallic shim located between said cap and base inner surfaces, said plate-like shim having first and second planar surfaces and a peripheral edge including a forwardmost edge portion parallel to said forward edges of said cap and base, said first planar shim surface facing and abutting said cap inner surface, said second planar shim surface facing and abutting said base inner surface, fasteners fastening said cap and base together with said shim therebetween, a continuous dispensing slot for said nozzle being formed between said base and said cap along said forward edge of said cap, at least one distribution chamber formed in said shim, said nozzle having an inlet for said at least one distribution chamber, said at least one distribution chamber comprising a plurality of distribution channels defining discrete pathways within said shim for evenly distributing and directing said flowable material from said inlet to predetermined points along at least a portion of said dispensing slot, said shim forwardmost edge portion being spaced rearwardly of said forward edge of said cap up to about 1/32 inch, said forward edge of said base extending forwardly of said forward edge of said cap by a distance within the range of from about 11/64 inch to about 3/16 inch, said distribution channels of said at least one distribution chamber being formed on one of said shim first and second surfaces and comprising a first channel dividing into a first channel set comprising two channels, said channels of said first channel set dividing into a second channel set comprising four channels, said distribution chamber dividing into a plurality of such channel sets from said first set to a final set, each set comprising twice the number of channels as the preceding set, said final channel set being located adjacent said nozzle dispensing slot with its channels perpendicular thereto, all of the channels of the channel sets having the same depth of approximately ½ the thickness of said shim, all channels of a given channel set having the same width, the width of the channels diminishing from set-to-set from said first set to said final set with the channels of said final set being narrowest.

2. The electrostatic nozzle claimed in claim 1 wherein said means fastening said cap, said shim and said base together comprise bolts extending through coaxial holes in said cap, said shim and said base, said bolts being so located in said nozzle as to preclude the need for resilient sealing means between said shim and said cap and between said shim and said base.

3. The electrostatic nozzle claimed in claim 1 including end portions of said shim extending beyond said nozzle dispensing slot, said end portions comprising field gates.

4. The electrostatic nozzle claimed in claim 1 including a plurality of identical, hydraulically independent distribution chambers formed in said shim in side-by-side relationship along the length of said shim, each distribution chamber comprising a plurality of channels defining discrete pathways within said shim for evenly distributing and directing said flowable material to predetermined points along said nozzle dispensing slot, said nozzle having an inlet for each of said distribution chambers.

5. The electrostatic nozzle claimed in claim 1 wherein said at least one distribution chamber is formed in said shim facing said inner surface of said cap, said nozzle inlet for said at least one distribution chamber comprising a perforation through said cap and an adjacent depression in said shim from which said distribution chamber extends, an inlet fitting of an inlet conduit being attached to said cap perforation, said conduit having an on-off valve therein, a source of said flowable material, said conduit being connected to said source.

6. The nozzle claimed in claim 1, including at least two shims located end-to-end between said cap and said base and both having forwardmost edges parallel to said forward edge of said cap and spaced rearwardly thereof up to about 1/32 inch.

7. The nozzle claimed in claim 1 including a plurality of shims, said shims being interchangeable, said shims differing only in shim thickness and the depth dimension of said at least one dispensing chamber thereof, said interchangeable shims giving said nozzle a flow rate range of from about 0.04 cc/min./6 inches of nozzle to about 200 cc/mon./6 inches of nozzle.

8. The nozzle claimed in claim 1 including a plurality of said distribution chambers formed in said shim in side-by-side relationship along the length of said shim, said distribution chambers being identical.

9. The electrostatic nozzle claimed in claim 2 including end portions of said shim extending beyond said nozzle dispensing slot and comprising field gates.

10. The nozzle claimed in claim 2 including at least two such shims located end-to-end between said cap and said base and both having forwardmost edges parallel to said forward edge of said cap and spaced rearwardly thereof over up to about 1/32 inch.

11. The nozzle claimed in claim 5 including a plurality of such shims, said shims being interchangeable, said shims differing only in shim thickness and the depth dimension of said at least one dispensing chamber thereof, said interchangeable shims giving said nozzle a flow rate range of from about 0.04 cc/min./6 inches of nozzle to about 200 cc/mon./6 inches of nozzle.

12. The electrostatic nozzle claimed in claim 4 including end portions of said shim extending beyond said nozzle dispensing slot and comprising field gates.

13. The electrostatic nozzle claimed in claim 4 wherein said distribution chambers are formed in said shim facing said inner surface of said cap, said inlet for each of said distribution chambers comprises a perforation through said cap and an adjacent depression in said shim from which said distribution chamber extends, an inlet fitting of an inlet conduit being attached to each of said cap inlet perforations, each inlet conduit being connected to a source of said flowable material, an on-off valve in each of said inlet conduits.

14. The nozzle claimed in claim 8 including a plurality of shims, said shims being interchangeable, said shims differing only in shim thickness and the depth dimension of said dispensing chambers thereof, said interchangeable shims giving said nozzle a flow rate range of from about 0.04 cc/min./6 inches of nozzle to about 200 cc/mon./6 inches of nozzle.

15. The electrostatic nozzle claimed in claim 14 wherein said distribution chambers are formed in said shim facing said inner surface of said cap, said inlet for each of said distribution chambers comprises a perforation through said cap and an adjacent depression in said shim from which said distribution chamber extends, an inlet fitting of an inlet conduit being attached to each of said cap inlet perforations, each inlet conduit being connected to a source of said flowable material, and an on-off valve in each of said inlet conduits.

16. The electrostatic nozzle claimed in claim 14 wherein each of said shims comprises at least two substantially identical shim plates located between said cap and said base in side-by-side relationship.

* * * * *